United States Patent [19]

Yoshikawa

[11] Patent Number: 4,919,070

[45] Date of Patent: Apr. 24, 1990

[54] ELECTROSTATIC FLOCKING DEVICE

[76] Inventor: Satonobu Yoshikawa, c/o Mesac Co., Ltd. 12-1, Kabuto-cho, Nihonbashi, Chuo-ku, Tokyo, Japan

[21] Appl. No.: 355,573

[22] Filed: May 23, 1989

[30] Foreign Application Priority Data

Jul. 22, 1988 [JP] Japan ..... 63-97232

[51] Int. Cl.[5] ..... B05B 5/02

[52] U.S. Cl. ..... 118/621; 427/26

[58] Field of Search ..... 118/626, 621; 427/26

[56] References Cited

U.S. PATENT DOCUMENTS 3,496,911 2/1970 Chmelar ..... 118/621

FOREIGN PATENT DOCUMENTS 1026839 7/1983 U.S.S.R. ..... 118/621

*Primary Examiner*—Bernard Nozick

*Attorney, Agent, or Firm*—Armstrong, Nikaido, Marmelstein, Kubovcik & Murray

[57] ABSTRACT

An electrostatic flocking device which comprises a hollow handle member, bearing means rotatably attached to one end of said handle member, a horizontal casing journalled in said bearing means, a rotary shaft extending horizontally within said casing, a gear motor drivingly connected to one end of said bearing means and a rotary sleeve connected to one end of said rotary shaft.

1 Claim, 2 Drawing Sheets

ELECTROSTATIC FLOCKING DEVICE

BACKGROUND OF THE INVENTION:

This invention relates to an electrostatic flocking device.

Japanese Utility Model Publication Nos. 20262/1976 and 9906/1977 disclose portable electrostatic flocking devices which cause fibers to necessarily fly upwardly and are not suitable for flocking the walls and floors of rooms and Japanese Utility Model Publication Nos. 14063/1976 and 7332/1976 disclose portable flocking devices which cause fibers to fly laterally and not suitable for flocking the ceilings and floors of rooms.

SUMMARY OF THE INVENTION

Thus, the present invention provides a novel and improved electrostatic flocking device which eliminates the disadvantages inherent in the above-mentioned prior art portable electrostatic flocking devices. According to the present invention, fine material such as fine fibers (they will be referred to merely as "fibers" hereinafter) are always piled in loose condition, but not in a mass or masses in a casing or container and electrodes are provided within the casing to cause the fibers to fly in effective directions for flocking an object or objects to be flocked so that faces such as the ceilings and floors of rooms which are generally difficult to be flocked by prior art flocking devices can be uniformly flocked.

According to the present invention, there is provided an electrostatic flocking device which comprises a hollow handle member wherein high voltage static electricity generation means connected to a power source by a cable and a cord drivingly connecting a second power source to a gear motor are disposed; bearing means rotatably attached to the base of said handle member and having a first support board on which said gear motor is mounted and a second support board on which a high voltage contact terminal embracing member is mounted, said first and second support boards being connected together by a plurality of circumferentially spaced and longitudinally extending support bars; a rotary horizontal casing journalled in a said bearing means and having a perforated sheet extending about the periphery of said casing and end plates at the opposite ends of the casing, one of said end plates being detachable; a rotary shaft extending horizontally within said casing and having a first connector secured to one end of said shaft for connection with the rotary shaft of said gear motor by a second connector and having a rotary sleeve secured to the other end, said rotary sleeve having a high voltage contact terminal received therein; a high voltage contact terminal embracing member partially received in the opening at the outer end of said rotary sleeve and having a high voltage contact terminal therein; a plurality of partition walls extending longitudinally and radially from said rotary shaft to said perforated sheet to divide the interior of said casing into compartments and provided with notches; a plurality of conductive boards disposed between said partition walls and extending in the longitudinal direction of said rotary shaft within the casing; a plurality of triangular electrodes erecting from said conductive boards; a connector for detachably connecting between said rotary shaft within the casing and said rotary shaft of the gear motor; a high voltage cable for connecting between said high voltage static electricity generation means and said high voltage contact terminal within the high voltage contact terminal; and a synthetic resin cover covering a sector of said perforated sheet.

The above and other objects and attendant advantages of the present invention will be more radily apparent to those skilled in the art from a reading of the following detailed description in conjunction with the accompanying drawings which show one preferred embodiment of the present invention for illustration purpose only, but not for limiting the scope of the same in any way.

PREFERRED EMBODIMENT OF THE INVENTION

Figure 1:
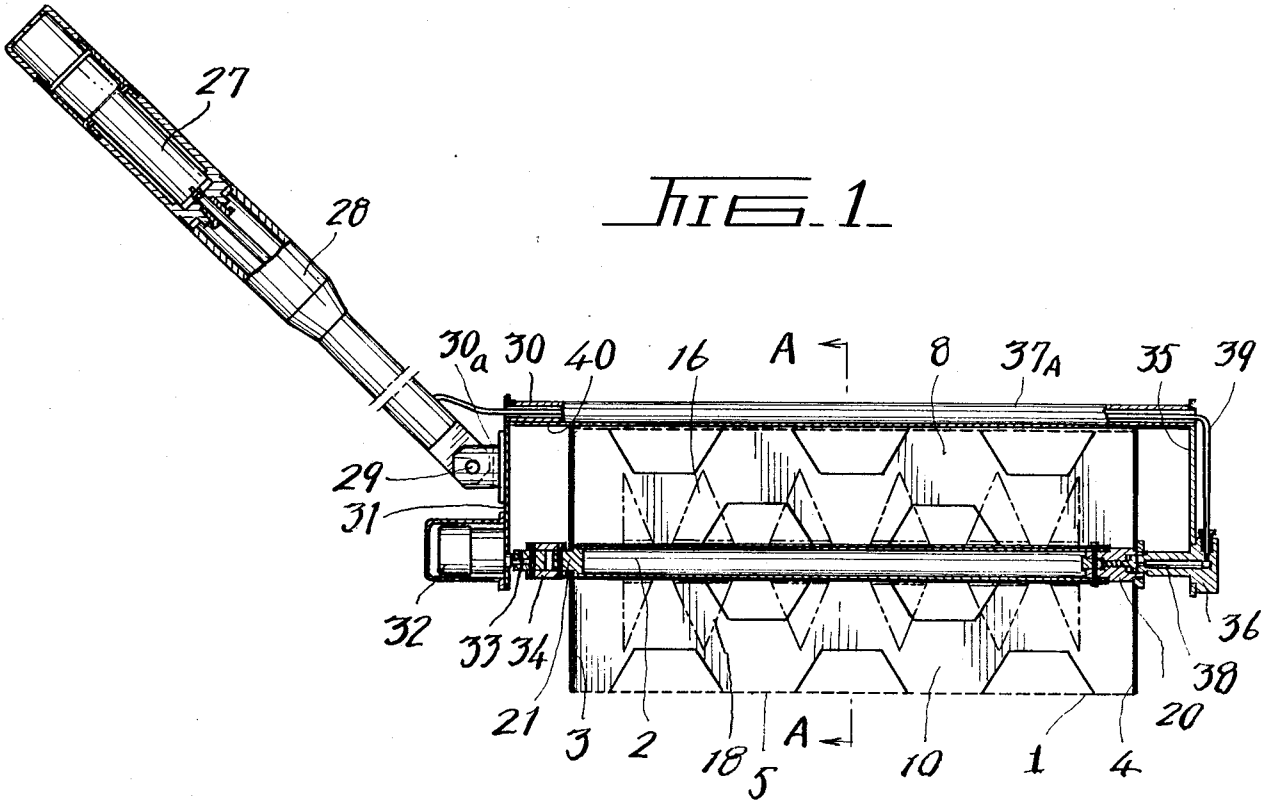
FIG. 1 is a longitudinally sectional view of the preferred embodiment of the electrostatic flocking device constructed in accordance with the present invention.

The present invention will be now described referring to the accompanying drawings and more particularly to FIG. 1. In FIG. 1, reference numeral 1 denotes a casing in the form of a horizontal rotary drum within which a rotary shaft 2 extends horizontally. End plates 3 and 4 are provided at the opposite ends of the drum 1 in coaxial relationship to the latter. The end plates 3, 4 are formed of an insulative material and one of the end plates functions as a detachable lid for opening and closing the drum 1. A thin perforated sheet 5 extends about the inner peripheral surface of the drum 1 and is secured at the opposite ends to the peripheries of the end plates 3, 4. In the embodiment illustrated in FIG. 1, the perforated sheet 5 is integrally formed with the end plate 3 and the end plate 4 functions as the detachable lid.

Figure 2:
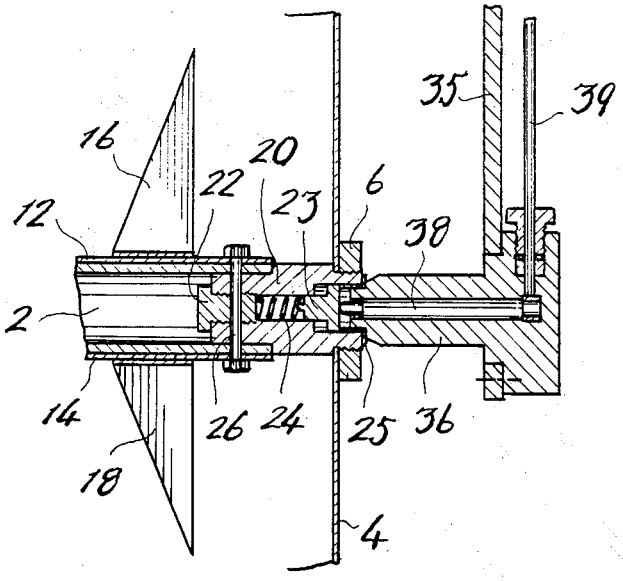
FIG. 2 is a fragmentary sectional view of the electric conduction mechanism of the device shown in FIG. 1.

In order that the perforated sheet 5 which reinforces the peripheries of the end plates can be easily attached to the end plates, the inner peripheries of the end plates may be formed with annular ribs. And in order that the detachable end plate can be attached to and detached from the drum 1, partition walls of which description will be made hereinafter may be provided extending radially outwardly from the rotary shaft 2 and annular ribs (not shown) are provided on the peripheries of the partition walls in coaxial relationship to the rotary shaft 2 so that the detachable end plate can be fitted on and separated from the ribs. In FIG. 2, reference numeral 6 denotes a nut in threaded engagement with the threaded end of a rotary sleeve 20 connected to the adjacent end of the shaft 2 for securing the detachable end plate 4 to the rotary shaft 2.

Figure 3:
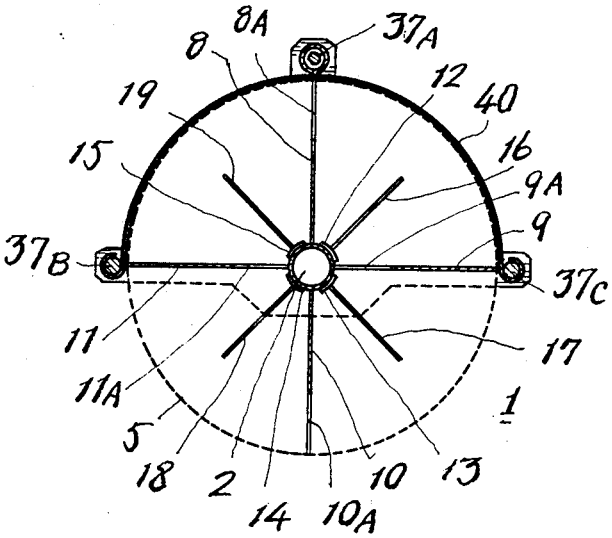
FIG. 3 is a cross-sectional view taken along the line A—A of FIG. 1.

A plurality of partition walls 8, 9, 10, 11 extend radially outwardly from the rotary shaft 2 to the perforated sheet 5 to divide the interior of the drum 1 into compartments and the side edges of the partition walls 8, 9, 10, 11 are provided with notches 8A, 9A, 10A, 11A adjacent to the rotary shaft 2 (see FIGS. 1 and 3). A plurality of elongate conductive metal boards 12, 13, 14, 15 of arcuate cross section are attached about the rotary shaft 2 in angurally spaced relationship extending in the logitudinal directions of the rotary shaft 2. A plurality of triangular conductive metal boards or electrodes 16, 17, 18, 19 erect from the conductive metal boards 12, 13, 14, 15, respectively, with the apices of the electrodes directing toward the perforated sheet 5. Furthermore, the above-mentioned rotary shaft 2 is hollow and formed of an insulative material and a connector 21 is fitted in one end portion of the rotary shaft 2. The connector is connected to the rotary shaft 33 of a gear motor 32 through a second connector 34.

A rotary sleeve 20 is fitted in the other end portion of the rotary shaft 2 and has a high voltage contact terminal 22 fitted therein. The contact terminal 22 is in the form of a bolt screwed in the thread on the inner periphery of the inner end portion of the sleeve 20 and a conductive button 23 is loosely fitted in the outer end portion of the sleeve 20 facing the terminal 22. A conductive spring 24 is interposed between and acts on the high voltage contact terminal 22 and button 23. An oiless bush 25 is disposed in the outer end portion of the rotary sleeve 20 externally of the button 23 to serve as a stopper for holding the button against spring out of the sleeve 20 and also forms the opening for receiving the tip of a high voltage contact terminal embracing member 36 of which description will be made hereinafter.

The outer ends of the conductive boards 12, 13, 14, 15 from which the electrodes 16, 17, 18, 19 erect are secured to the rotary shaft 2 by means of a bolt 26 extending transversely of the rotary sleeve 20 and high voltage contact terminal 22 and the bolt serve to conduct electricity to the conductive boards 12, 13, 14, 15 (FIG. 2).

Next, description will be made on bearing means 30 for journalling the drum type casing 1.

The bearing means 30 comprises a support board 31 on which the inner end of a hollow handle member 28 wherein high voltage static electricity generation means 27 connected to a power source (not shown) via a cable (not shown) and the power source connection cord (not shown) of the gear motor 32 are housed is rotatably mounted and the rotary shaft 33 of the gear motor 32 is connected to the connector 21 of the rotary shaft 2 by a connector 34 (FIG. 1). The bearing means 30 also comprises another support board 35 where the tip of the high voltage contact terminal embracing member 36 is fitted in the rotary sleever 20. The support boards 31, 35 are connected together by means of at least three support bars 37A, 37B, 37C which extend between the support boards in a circumferentially spaced relationship. The handle member 28 is pivotally attached to a bracket **30*a* extending from the support board 31 by a pivot pin 29**.

The high voltage contact terminal embracing member 36 is, of course, formed of an insulative material and a high voltage contact terminal 38 is embraced by the embracing member 36. The leading or inner end of the terminal 38 is formed as a conductive pin adapted to contact the conductive button 23. The conductive pin or high voltage contact terminal is so disposed within the high voltage contact terminal embracing member 36 that the base of the pin may be connected to the contact of a high voltage cable 39 from the high voltage static electricity generation means 27 disposed within the handle member 28 and to the high voltage static electricity generation means 27 in the handl member 28.

Furthermore, one of the support bars 37A, 37B, 37C receives the high voltage cable 39 electrically connected to the base of the conductive pin or high voltage contact terminal 38 disposed within the high voltage contact terminal embracing member 36.

In order to mount the casing 1 on the bearing means 30, the rotary shaft 33 of the gear motor 32 mounted on the support board 31 is detachably connected to the connector 21 for the rotary shaft 2 for the casing 1 by the connector 34, the tip of the high voltage contact terminal embracing member 36 supported on the other support board 35 is fitted in the opening in the rotary sleeve 20 and the conductive button 23 is caused to contact the inner end of the high voltage contact terminal or conductive pin 38 embraced by the high voltage contact terminal embracing member 36. The sector of the thin perforated sheet 5 on which the support boards 37A, 37B, 37C are disposed is covered by a polyethylene film or cover 40.

The perforated sheet may be replaced by a screen and all the components other than the conductive components can be formed of an insulative material within the scope of the present invention.

In operation, the casing 1 is removed from the rotary shaft 33 of the gear motor 32 supported on the support board 31 and from the tip of the high voltage contact terminal embracing member 36 supported on the support board 35 and the nut 6 is loosened from the rotary sleeve 20. The end plate 4 is then removed for throwing a charge of fibers into the casing 1. Thereafter, the end plate 4 is replaced by reversing the procedure described just above. Thereafter, the casing 1 is then mounted on the bearing means 30. The high voltage static electricity producing means 27 mounted within the handle member 28 is energized by turning the associated power source on to produce high voltage static electricity. The thus produced high voltage static electricity is conducted through the high voltage cable 39, the high voltage contact terminal 38 or conductive pin embraced by the high voltage contact terminal member 36 within the bearing means 30 and the high voltage contact terminal 22 within the rotary sleeve 20 and the conductive bolt 26 to the conductive boards 12, 13, 14, 15 and the electrodes 16, 17, 18, 19.where a discharge phenomenon occures. And the drive source of the gear motor 32 is turned on the drive the gear motor 32 which in turn rotates the casing 1 through the rotary shaft 33 of the motor.

The fibers held within the rotating casing 1 are caused to contact the energized conductive boards 12, 13, 14, 15 to be charged thereby and also contact the electrodes 16, 17, 18, 19 extending from the conductive boards 12, 13, 14, 15 to be grounded thereby. The charged fibers are subjected to the effect of the electric field generated between an object having adhesive applied thereto to be flocked (not shown) and driven through the perforations in the preforated sheet 5 or the openings in the screen (not shown) to the object whereby the fibers stick to the adhesive layer on the object to thereby flock the object.

As the casing 1 rotates, the charged fibers within the casing tend to fly through the perforations in the perforated sheet 5 out of the casing, but since one sector of the periphery of the casing is covered by the synthetic resin cover 40, the formation of the electric field is prevented between the covered sector of the casing and the electrodes whereby the flying of the charged fibers through the covered sector of the casing is prevented.

Here it should be noted that in the prior art electrostatic flocking devices, the charged fibers held within the casing tend to agglomerate to a mass or masses due to the charge phenomenon to thereby obstruct the uniform flying of the charged fibers out of the casing.

However, in the electrostatic flocking device of the present invention, since the casing 1 is in the form of a drum which is divided into compartments by partition walls 8, 9, 10, 11, as the casing 1 rotates, the electrodes 16, 17, 18, 19 extending from the conductive boards 12, 13, 14, 15 secured to the rotary shaft 2 strike against the fibers to agitate them so as to prevent the agglomeration of the fibers into a mass or masses. Furthermore, since the partition walls 8, 9, 10, 11 are formed with notches 8A, 9A, 10A, 11A on the side edges thereof adjacent to the rotary shaft 2, respectively, the charged fibers held within the casing 1 move through the notches 8A, 9A, 10A, 11A in the partition walls 8, 9, 10, 11 into the successive compartments and are uniformly distributed within the compartments. Thus, the fibers are always agitated and loosely and uniformly piled within the casing.

Furthermore, as the casing rotates, the fibers held within the casing are caused to contact the electrodes and maintained in satisfactorily charged condition. This assures that the fibers can fly to the object to be flocked in satisfactory condition.

When the power sources of the high voltage static electricity generation means and gear motor are deenergized, it is a matter of course that the discharge of the electrodes within the casing terminates and the rotation of the casing ceases.

As described hereinabove, according to the present invention, the charged fibers held in the casing are prevented from agglomeration to a mass or masses and further satisfactorily charged whereby the fibers are flocked in optimum condition. In addition, the fibers can be suitably flocked even to the ceilings and floors of rooms.

While one preferred embodiment of the present invention has been shown and described in detail, it will be understood that the same is for illustration purpose only and not to be taken as a definition of the invention, and reference should be given to the appended claims.

What is claimed is:

1. An electrostatic flocking device comprising a hollow handle member wherein high voltage static electricity generation means connected to a power source by a cable and a cord for drivingly connecting a second power source to a gear motor are disposed; bearing means rotatably attached to the base of said handle member and having a first support board on which said gear motor is mounted and a second support board on which a high voltage contact terminal embracing member is mounted, said first and second support boards being connected together by a plurality of circumferentially spaced and longitudinally extending support bars; a rotary horizontal casing journalled in said bearing means and having a perforated sheet extending about the periphery of said casing and end plates at the opposite ends of the casing, one of said end plates being detachable; a rotary shaft extending horizontally within said casing and having a first connector secured to one end of said shaft for connection with the rotary shaft of said gear motor by a second connector and having a rotary sleeve secured to the other end, said rotary sleeve having a high voltage contact terminal received therein; a high voltage contact terminal embracing member partially received in the opening at the outer end of said rotary sleeve and having a high voltage contact terminal therein; a plurality of partition walls extending longitudinally and radially from air rotary shaft to said perforated sheet to divide the interior of said casing into compartments and provided with notches; a plurality of conductive boards disposed between said partition walls and extending in the longitudinal direction of said rotary shaft within the casing; a plurality of triangular electrodes erecting from said conductive boards; a connector for detachably connecting between said rotary shaft within said casing and said rotary shaft of the gear motor; a high voltage cable for connecting between said high voltage static electricity generation means and said high voltage contact terminal within the high voltage contact terminal; and a synthetic resin cover covering a sector of said perforated sheet.

* * * * *